US009845591B2

(12) United States Patent
Gilmore

(10) Patent No.: US 9,845,591 B2
(45) Date of Patent: Dec. 19, 2017

(54) WATER DELIVERY APPARATUS WITH MULTI-CHANNEL HOSE

(71) Applicant: Munster Simms Engineering Limited, County Down (GB)

(72) Inventor: Edward John Gilmore, County Down (GB)

(73) Assignee: Munster Simms Engineering Limited, County Down (GB)

( * ) Notice: Subject to any disclaimer, the term of this patent is extended or adjusted under 35 U.S.C. 154(b) by 0 days.

(21) Appl. No.: 14/855,372

(22) Filed: Sep. 15, 2015

(65) Prior Publication Data

US 2016/0002896 A1 Jan. 7, 2016

Related U.S. Application Data

(63) Continuation of application No. 12/664,587, filed as application No. PCT/EP2008/004809 on Jun. 16, 2008, now abandoned.

(30) Foreign Application Priority Data

Jun. 14, 2007 (GB) ..... 0711496.0
Oct. 3, 2007 (GB) ..... 0719338.6

(51) Int. Cl.
*E03C 1/00* (2006.01)
*E03C 1/02* (2006.01)
*E03C 1/04* (2006.01)

(52) U.S. Cl.
CPC ..... *E03C 1/025* (2013.01); *E03C 1/021* (2013.01); *E03C 1/0408* (2013.01)

(58) Field of Classification Search
CPC ..... E03C 1/021; E03C 1/0408; F16L 9/133; F16L 9/18; F16L 9/19; F16L 39/00; F16L 39/02
USPC ..... 4/675, 676
See application file for complete search history.

(56) References Cited

U.S. PATENT DOCUMENTS

| | | | | |
|---|---|---|---|---|
| 1,924,942 A | 8/1933 | Samuel | | |
| 1,953,701 A * | 4/1934 | Clark | F16L 9/18 | 138/104 |
| 6,453,950 B1 | 9/2002 | Smith | | |
| 6,692,037 B1 | 2/2004 | Lin | | |
| 2008/0223471 A1* | 9/2008 | Guo | F16L 9/19 | 138/113 |

FOREIGN PATENT DOCUMENTS

| | | |
|---|---|---|
| EP | 0080591 A1 | 6/1983 |
| EP | 0733747 A2 | 9/1996 |

(Continued)

OTHER PUBLICATIONS

PCT/EP2008/004809, International Search Report, 2 pages.
PCT/EP2008/004810, International Search Report, 2 pages.

*Primary Examiner* — Viet Le
(74) *Attorney, Agent, or Firm* — Lathrop & Gage LLP

(57) ABSTRACT

A hot and cold water delivery apparatus comprising a multi-channel hose for simultaneously carrying hot and cold water to a water delivery device such as the spray head of a shower. The preferred hose is formed from an extruded length of material with a longitudinally running dividing wall to create the channels. A shut off valve may be provided for selectably connecting the channels to a source of hot and cold water respectively.

17 Claims, 15 Drawing Sheets

(56) References Cited

FOREIGN PATENT DOCUMENTS

| | | | |
|---|---|---|---|
| FR | 2398247 | A1 | 2/1979 |
| FR | 2774148 | A1 | 7/1999 |
| WO | 2006/120443 | | 11/2006 |

* cited by examiner

WATER DELIVERY APPARATUS WITH MULTI-CHANNEL HOSE

CROSS-REFERENCE TO RELATED APPLICATIONS

This application is a continuation of U.S. application Ser. No. 12/664,587, filed Jul. 20, 2010, which is the United States National Stage of International Application No. PCT/EP2008/004809, filed Jun. 16, 2008, which claims the benefit of Patent Applications GB 0711496.0, filed Jun. 14, 2007 and GB 0719338.6, filed Oct. 3, 2007, all of which are hereby incorporated by reference to the extent there is no inconsistency with the present disclosure.

FIELD OF THE INVENTION

The present invention relates to water delivery apparatus and to hose assemblies. The invention relates particularly, but not exclusively, to water delivery apparatus and hose assemblies for use in shower units, especially for use in boats or other vehicles.

BACKGROUND TO THE INVENTION

In some plumbing applications, it is necessary to transport hot and cold water separately from the respective hot and cold water supplies to an outlet, for example a tap, or other device having a mixer. Conventionally, the hot and cold water is transported by two separate pipes. However, in some cases, for example the water supply system of a boat or caravan, it is considered to be unsightly and cumbersome to provide two separate water pipes for this purpose.

It would be desirable to mitigate this problem.

SUMMARY OF THE INVENTION

Accordingly, a first aspect of the invention provides a hot and cold water delivery apparatus comprising a hose having a first channel for carrying hot water during use, and a second channel for carrying cold water during use, wherein one end of said hose is connectable both to a source of hot water and a source of cold water, the other end of the hose being connected to a water delivery device, the water delivery device having a first port connected to said first channel and a second port connected to said second channel.

In preferred embodiments, said water delivery device comprises a water dispensing nozzle, especially the spray head of a shower. The water dispensing nozzle typically includes means for mixing, in use, water received from said first and second channels, and means for dispensing the mixed water. Preferably, the mixing means comprises a mixing device controllable to adjust the relative quantities of hot and cold water mixed during use.

Preferably, the first and second channels are located side-by-side and run along substantially the entire length of the hose. More preferably, said first and second channels are formed by a dividing wall running longitudinally of the hose.

Alternatively, said water delivery device comprises a valve apparatus having third and fourth ports in selectable fluid communication with said first and second ports respectively, the valve apparatus being operable between an open state, in which said respective ports are in fluid communication, and a closed state in which said respective ports are isolated from one another.

In preferred embodiments, said valve apparatus comprises a core member rotatably located in a body, said first and second ports being provided on said core member, said third and fourth ports being provided on said body, said core member including respective channels for carrying water between said respective ports, said channels being in fluid communication with, or isolated from, said third and fourth ports depending on the relative rotational position of said core and said body.

Advantageously, said core member includes a handle for effecting rotation of the core member with respect to the body to operate the valve apparatus between said open and closed states.

In some embodiments, said one end of the hose is connectable to said hot and cold water sources by a valve apparatus having a first port connected to said first channel and a second port connected to said second channel, third and fourth ports in selectable fluid communication with said first and second ports respectively, the valve apparatus being operable between an open state, in which said respective ports are in fluid communication, and a closed state in which said respective ports are isolated from one another. For example, the hose may extend between two of said valves, or between one of said valves and a water dispensing nozzle.

A second aspect of the invention provides shower comprising a water delivery apparatus according to the first aspect of the invention.

A third aspect of the invention provides a valve apparatus, particularly for use with said hose, the valve apparatus having a first port and a second ports, third and fourth ports in selectable fluid communication with said first and second ports respectively, the valve apparatus being operable between an open state, in which said respective ports are in fluid communication, and a closed state in which said respective ports are isolated from one another, the valve advantageously having a rotatable core member.

From another aspect the invention provides a hose assembly comprising a hose and an adaptor for coupling the hose to, for example, a shower head, wherein the hose comprises an outer pipe and an inner pipe located within the outer pipe to define a space therebetween, and wherein the adaptor includes an inlet port comprising a first inlet and a second inlet, the arrangement being such that, when the hose is connected to the adaptor, the first inlet is in fluid communication with the inside of the inner pipe and the second inlet is in fluid communication with the space between the inner and outer pipes. The adaptor typically also comprises an outlet port having first and second outlets, the first inlet being in fluid communication with the first outlet and the second inlet being in fluid communication with the second outlet. This allows fluid, typically water, which passes through the hose and adaptor during use to be kept separately from one another.

The second inlet preferably comprises a plurality of apertures positioned outwardly of the first inlet with respect to the longitudinal axis of the adaptor. Conveniently, the apertures are spaced apart around at least part of the periphery of the first inlet, preferably being substantially equidistant from the first inlet.

The inlet port preferably has an outer plug member shaped and dimensioned to fit within the outer pipe, and preferably to engage with the internal surface of the outer pipe, and an inner plug member shaped and dimensioned to fit within the inner pipe, and preferably to engage with the internal surface of the outer pipe.

In the preferred embodiment, the inner plug projects from the outer plug.

The adaptor advantageously includes a gripping device which, in the preferred embodiment, is located around the inner plug. The gripping device preferably comprises at least two flexible, and preferably resilient, projections or tines spaced apart around the inner plug. The gripping device is shaped and dimensioned to fit between the inner and outer pipes. Said second inlet is preferably comprised of one or more apertures located between adjacent tines.

A still further aspect of the invention provides a hose assembly comprising a hose and an adaptor for coupling the hose to, for example, a shower head, wherein the hose comprises first and second channels located adjacent to one another, and wherein the adaptor includes an inlet (or outlet depending on the mode of use) comprising a first port and a second port, the arrangement being such that, when the hose is connected to the adaptor, the first port is in fluid communication with one of said channels and the second port is in fluid communication with the other of said channels. The adaptor typically also comprises an outlet port having first and second outlets, the first inlet being in fluid communication with the first outlet and the second inlet being in fluid communication with the second outlet. This allows fluid, typically water, which passes through the hose and adaptor during use to be kept separately from one another.

In the preferred embodiment, the inlet port of the adaptor comprises first and second plug members, each having a respective port or aperture at its free end. The plugs are shaped and dimensioned to fit into a respective channel, preferably to substantially fill the respective channel.

Typically, the channels are formed by providing a dividing wall along the length of the hose. The plugs are spaced apart to define a gap therebetween, the gap being shaped and dimensioned to receive the wall.

In the preferred embodiment, the inlet comprises a bifurcated male connector of which said plugs are respective branches extending from a common base. In this case, it is preferred that a portion of the dividing wall adjacent the end of the hose is cut away.

The shower head is preferably of the type comprising an elongate body and may be substantially bar-like or linear in shape. For example, in some embodiments, the shower head may be substantially or generally rounded or circular in transverse cross section. In preferred embodiments, the shower head includes a mixing unit for mixing hot and cold water and may also include one or more user control mechanisms.

From another aspect, the invention provides a fluid conducting apparatus, for example a shower unit or a hose assembly for a shower unit or other device, including a hose comprising an outer pipe and an inner pipe located within the outer pipe to define a space therebetween, wherein said hose is in fluid communication with a source of a first fluid (typically a liquid, e.g. hot or cold water) and with a source of a second fluid (typically a liquid, e.g. cold or hot water), and wherein, during use said first fluid passes through said inner pipe and said second fluid passes through said space.

A further aspect of the invention provides a fluid conducting apparatus, for example a shower unit or a hose assembly for a shower unit or other device, including a hose comprising first and second channels located side by side, wherein said hose is in fluid communication with a source of a first fluid (typically a liquid, e.g. hot or cold water) and with a source of a second fluid (typically a liquid, e.g. cold or hot water), and wherein, during use said first fluid passes through said first channel and said second fluid passes through said second channel.

From another aspect, the invention provides an adaptor, or valve assembly, comprising first and second ports, and a connector comprising third and fourth ports, the connector being adapted for insertion into a hose or conduit, especially one comprising first and second channels located adjacent one and other. The adapter is operable between an open state in which fluid, especially water, is able to flow through the adaptor via said first and third ports and via said second and fourth ports, in a closed state in which the fluid is prevented from flowing through the adaptor.

Other preferred features are recited in the dependent claims.

Further advantageous aspects of the invention will become apparent to those ordinarily skilled in the art upon review of the following description of specific embodiments of the invention and with reference to the accompanying drawings.

BRIEF DESCRIPTION OF THE DRAWINGS

Embodiments of the invention are now described by way of example and with reference to the accompanying drawings in which.

DETAILED DESCRIPTION OF THE DRAWINGS

Figure 1:
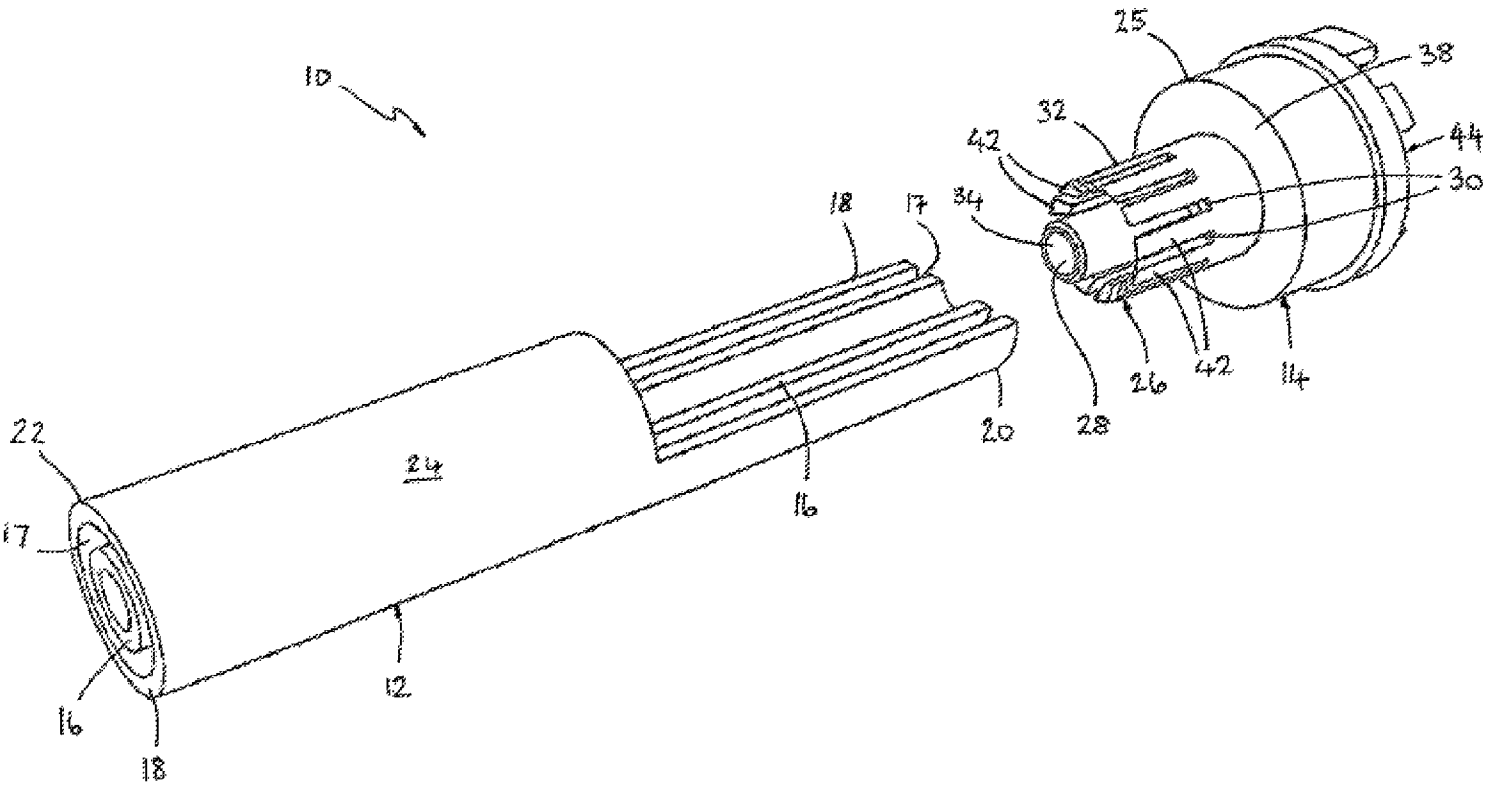
FIG. 1 is an exploded perspective view of a hose assembly embodying an aspect of the invention, a portion of the hose being cut away for purposes of illustration.
Figure 2:
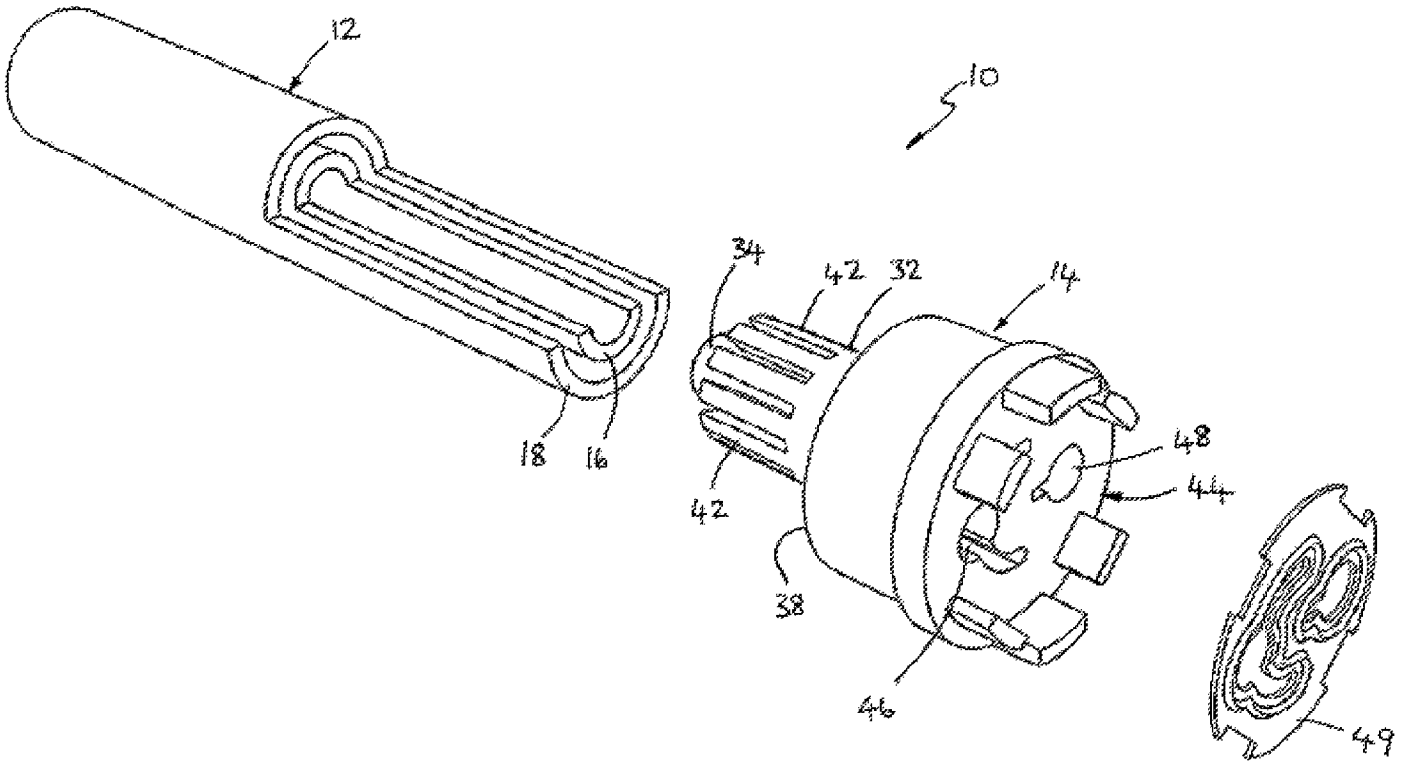
FIG. 2 is an alternative exploded perspective view of the hose assembly of FIG. 1.
Figure 3:
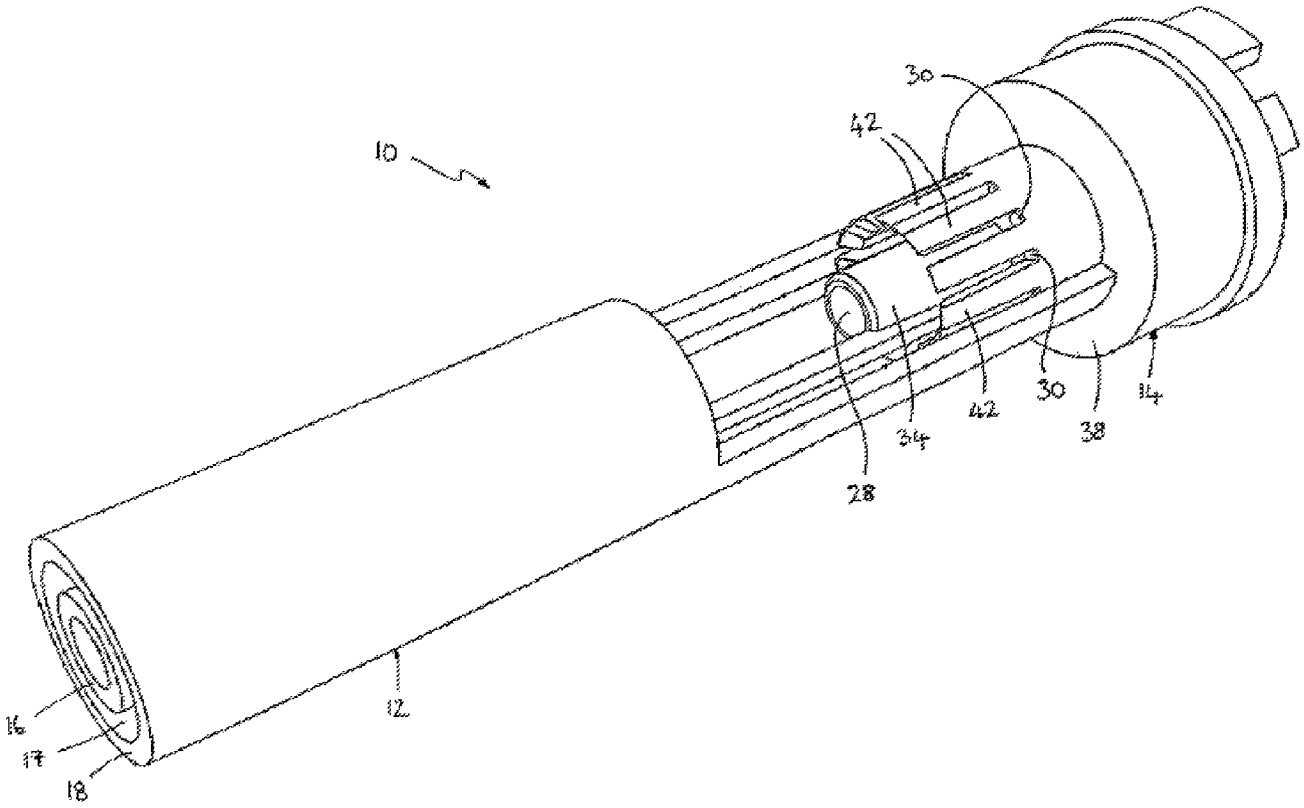
FIG. 3 is a perspective view of the hose assembly of FIG. 1 in an assembled state.
Figure 4:
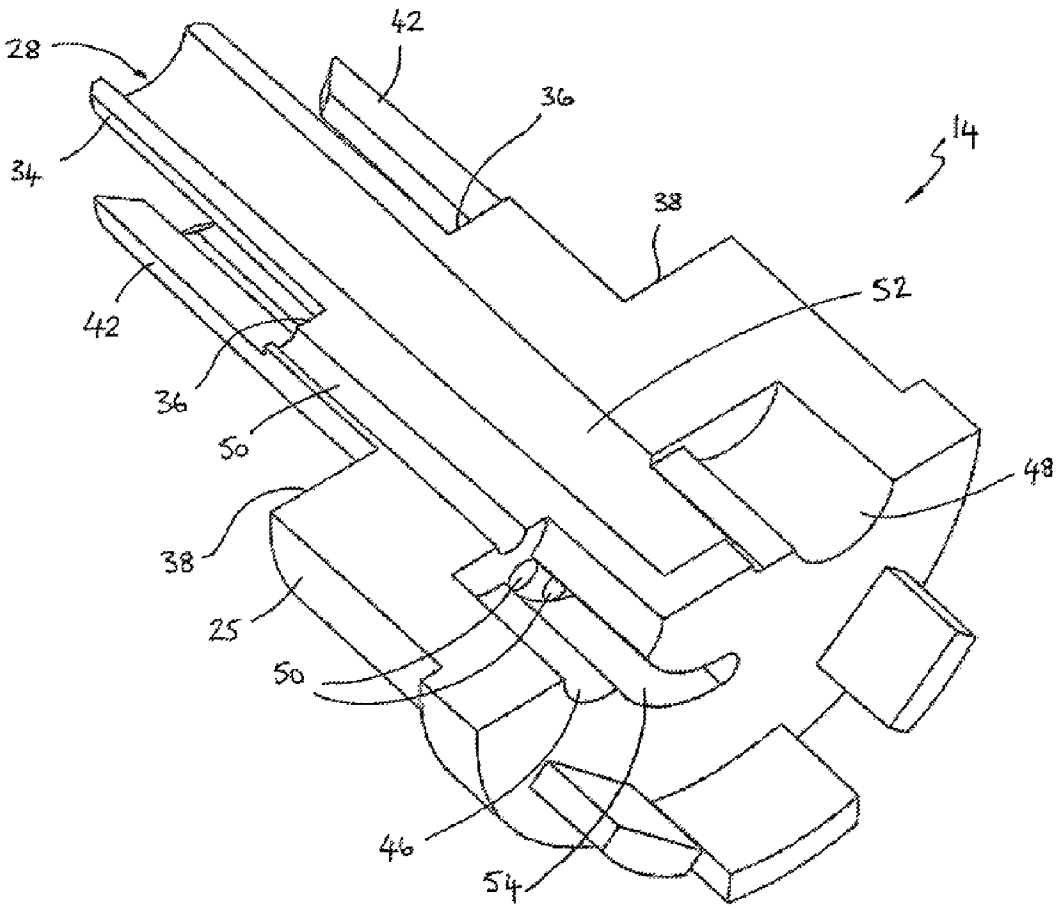
FIG. 4 is a perspective section view of a manifold included in the hose assembly of FIG. 1.
Figure 5:
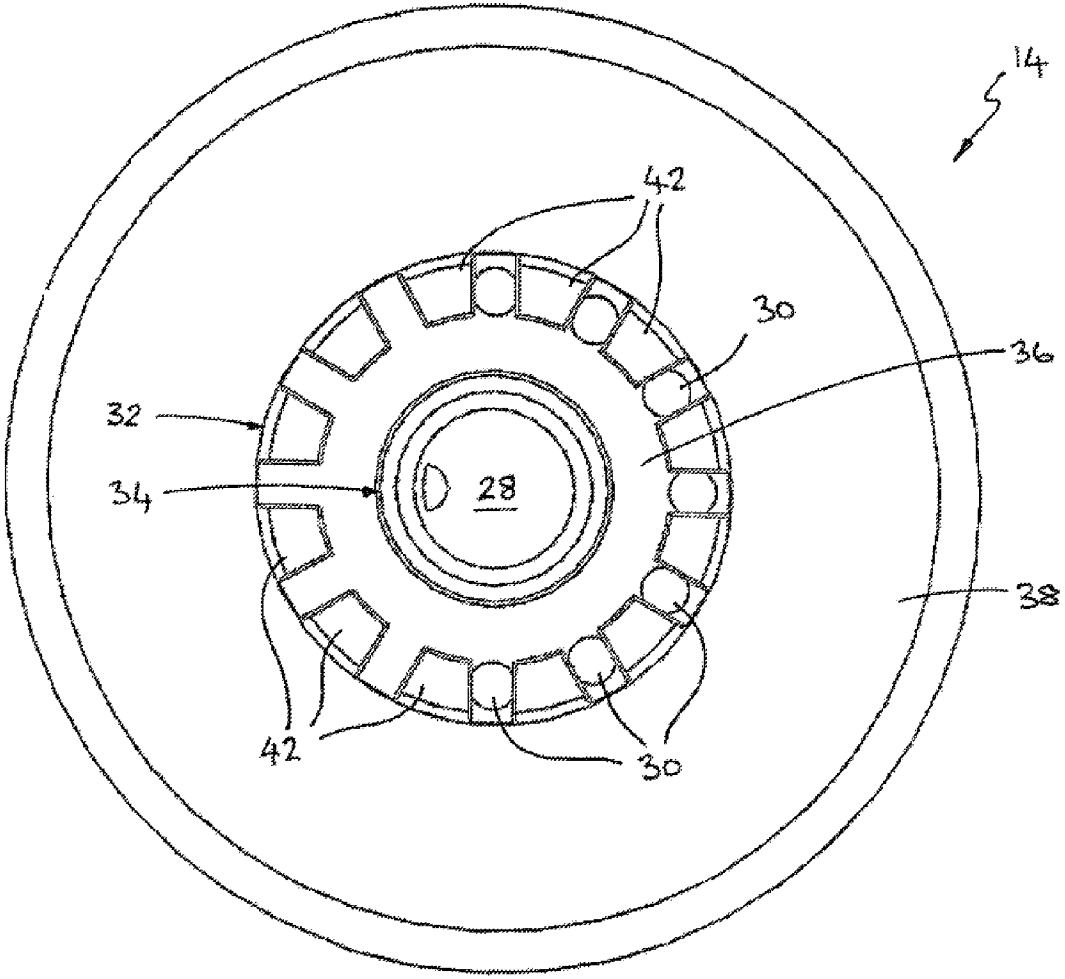
FIG. 5 is an end view of the manifold of FIG. 4.

Referring now in particular to FIGS. 1 to 5 of the drawings, there is shown, generally indicated as 10, a hose assembly embodying one aspect of the invention.

The hose assembly 10 comprises a hose 12 and an adaptor or manifold 14. The manifold 14 is connectable to a spray head, e.g. a shower head, or other water delivery device (not shown in FIGS. 1 to 5) so that, in use, hot and cold water carried simultaneously by the hose 12 can be supplied to the shower head via the manifold 14.

The hose 12 comprises an inner pipe 16 located within an outer pipe 18 to define a gap 17 therebetween. Preferably, the pipes, or tubes, 16, 18 are substantially concentric or coaxial with one another. The pipes 16, 18 may be held in position relative to one another by any convenient means, e.g. one or more spacer elements (not shown). In use one end 20 of the hose is connected to the manifold 14, the other end 22 being connected to a supply of hot and cold water (not shown). Advantageously, the hose 12 is connected to the water supply such that, in use, hot water is carried by the inner pipe 16, while cold water is carried by the gap between the pipe 16, 18. As a result, the outer surface 24 of the hose 12 may be kept relatively cool. The pipes 16, 18 may be formed from any suitable material, typically plastics or rubber and, typically, are flexible. It is noted that, in the drawings, a portion of the end 20 of the hose 12 is cut away for illustration purposes only, and the hose 12 is shortened for convenience of illustration.

The manifold 14 has a body 25 which includes an inlet port 26 comprising a first inlet, which in the illustrated embodiment comprises an aperture 28, and a second inlet, which in the illustrated embodiment comprises a plurality of second apertures 30, the second apertures 30 being located outwardly of the first aperture 28 with respect to the longitudinal axis of the manifold 14. Conveniently, the second apertures 30 are spaced apart around part of the periphery of the first aperture 28, preferably being substantially equidistant from the first aperture 28. As may best be seen from FIG. 5, in the preferred embodiment, the inlet port 26 is substantially circular in transverse cross-section, the second apertures 30 each being located on a respective notional radial line from the first aperture 28, the first aperture 28 conveniently being located substantially at the centre or longitudinal axis of the manifold 14. In the illustrated embodiment, the second apertures 30 are distributed around approximately half of the first aperture 28, although in alternative embodiments (not illustrated), the second apertures 30 may be distributed around more or less of the first aperture 28. Moreover, while it is preferred to provide a plurality of second apertures 30, it will be understood that a single second aperture 28 may alternatively be provided.

The inlet port 26 has an outer plug member 32 shaped and dimensioned to fit within the outer pipe 18, and preferably to engage with the internal surface of the outer pipe 18. The inlet port 26 also has an inner plug member 34 shaped and dimensioned to fit within the inner pipe 16, and preferably to engage with the internal surface of the outer pipe 16. The inner plug 34 is preferably positioned such that it does not extend beyond the outer plug 32 in a transverse direction. Conveniently, the inner and outer plugs 32, 34 are substantially concentric or coaxial with one another and are preferably centred substantially at the longitudinal axis of the manifold 14.

In the preferred embodiment, the inner plug 34 projects from the outer plug 32. The outer plug 32 has an abutment surface 36 which extends around the inner plug 34 and in which the second apertures 30 are provided. Preferably, the apertures 30 are spaced apart from the inner plug 34 by a distance at least equal to the thickness of the inner pipe 16. The outer plug 32 projects from the body 25 such that the body 25 defines an abutment surface 38 around the outer plug 32. The width of the abutment surface 38 is at least equal to the thickness of the outer pipe 18.

The inlet port 26 advantageously includes a gripping device located around the inner plug 34. The gripping device may take the form of sleeve or sheath (not illustrated), but preferably comprises at least two projections or tines 42 spaced apart around the inner plug 34. The gripping device 42 is spaced apart from the inner plug 34 by a distance at least equal to the thickness of the inner pipe 16. The device 42 is advantageously self-supporting, flexible and resilient and may conveniently be co-formed with the body 25, in particular the outer plug 32. In the preferred embodiment, the tines 42 are arranged to flex resiliently towards the inner plug 34. Conveniently, the tines 42 project from the outer plug 32 in a direction substantially, or generally, parallel with the inner plug 34. The preferred arrangement has the tines 42 projecting from the abutment surface 36 with the second apertures 30 being located between adjacent tines 42.

The gripping device 42 is shaped and dimensioned to fit between the inner and outer pipes 16, 18, and preferably to engage with the outer surface of the inner pipe 16 and the inner surface of the outer pipe 18. Hence, the thickness of the tines 42 (in the radial direction as viewed in FIG. 5) is substantially equal to, or less than, the radial spacing between the inner and outer pipes 16, 18.

When the hose 12 and the manifold 14 are assembled (FIG. 3), the hose 12 is fitted to the inlet port 26 such that the outer pipe 18 fits over the outer plug 32 while the inner pipe 16 fits over the inner plug 34, the tines 42 being located between the pipes 16, 18. Although not shown in the drawings, it is preferred that a portion of the inner pipe 16 is cut back from the end 20 of the hose 12 to allow the outer pipe 18 to abut with the abutment surface 38 and, preferably also, to allow the inner pipe 16 to abut with the abutment surface 36. In order to secure the hose 12 in place, a tie, clip or other gripping device (not shown), for example a jubilee clip, may be fitted around the external surface of the hose 12 in register with the tines 42. When the clip or other device is tightened, it causes the tines 42 to flex inwardly and to clamp the inner pipe 16 against the inner plug 34. If desired, a second clip or other gripping device can be fitted around the external surface of the hose 12 in register with the base of the outer plug 32.

During use, water delivered to the manifold 14 via the inner pipe 16 passes into the manifold 14 via the first aperture 28, while water delivered via the gap 17 enters the manifold via the second apertures 30.

In the illustrated embodiment, it is assumed that the hose assembly 10 is intended for use with a spray head, or other water dispensing device (not shown), which includes a mixing unit and so the manifold 14 is required to keep the hot and cold water supplies separate as they pass through it. Hence, the manifold 14 includes an outlet port 44, which is adapted to be connected to the spray head or other apparatus, and which comprises a first outlet aperture 48 and a second outlet aperture 46. One or more channels 50 are formed in the body 25 to provide a path for water to travel between the apertures 30 and the second outlet 46. One or more channels 52 are formed in the body 25 to provide a path for water to travel between the aperture 28 and the first outlet 48. A washer 49 may be provided to improve the seal between the manifold 14 and the spray head or other apparatus. In the illustrated embodiment, a respective channel 50 leads from each of apertures 30 to a common chamber 54 which leads to the outlet 46.

In order to feed hot and cold water into the other end 22 of the hose 12, any suitable adaptor or manifold (not shown)

may be used. Advantageously, an adaptor or manifold having an outlet port substantially the same or similar to the inlet port 26 may be used.

It will be understood that the hose may have more than two channels. The or each additional channel being formed in any convenient manner, e.g. by one or more respective pipes. The or each additional channel may be used for any suitable purpose, e.g. carrying fluid (for example, water, pressurised air or liquid soap) or a utility cable, e.g. a power or communications cable.

Figure 6:
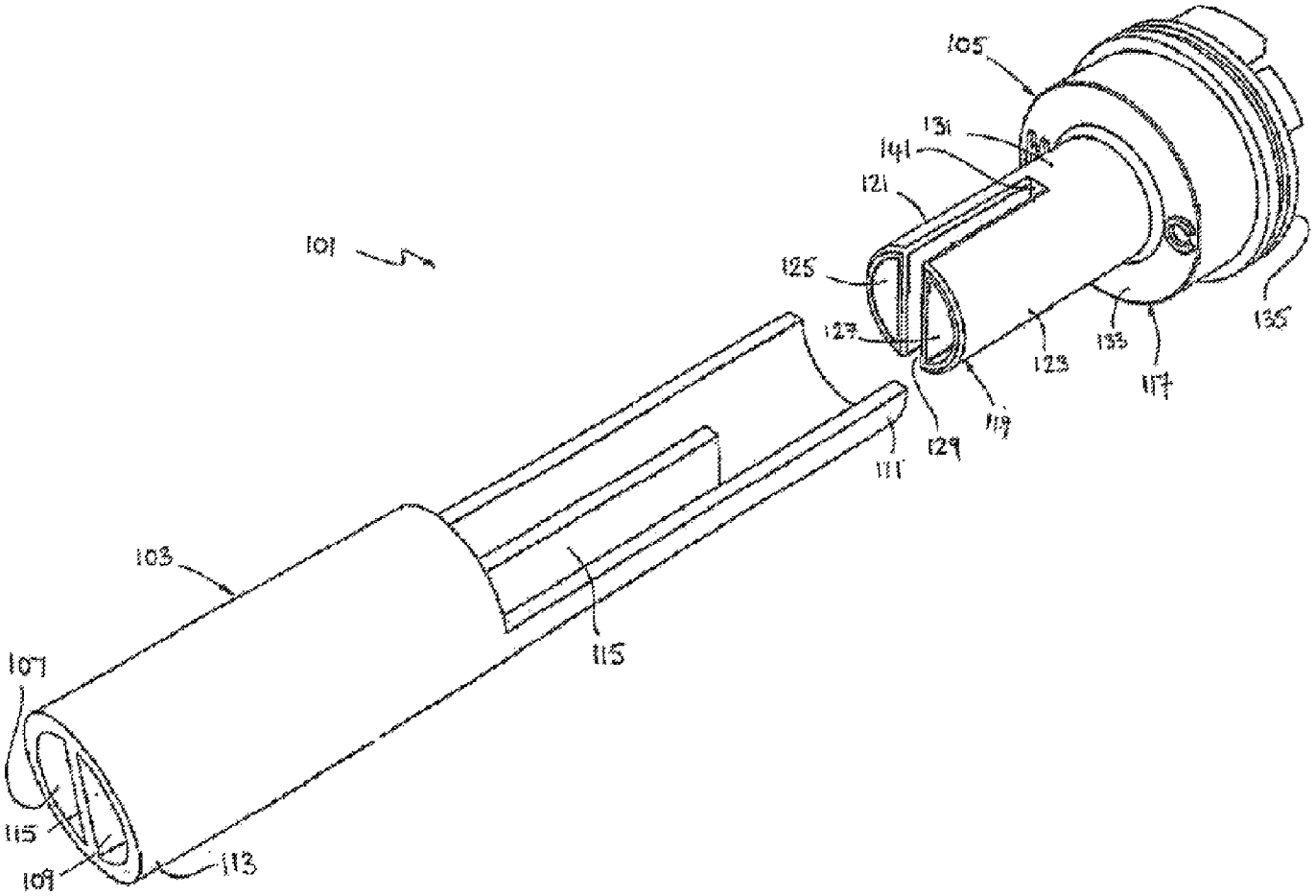
FIG. 6 is an exploded perspective view of a hose assembly embodying a further aspect of the invention, a portion of the hose being cut away for purposes of illustration.
Figure 7:
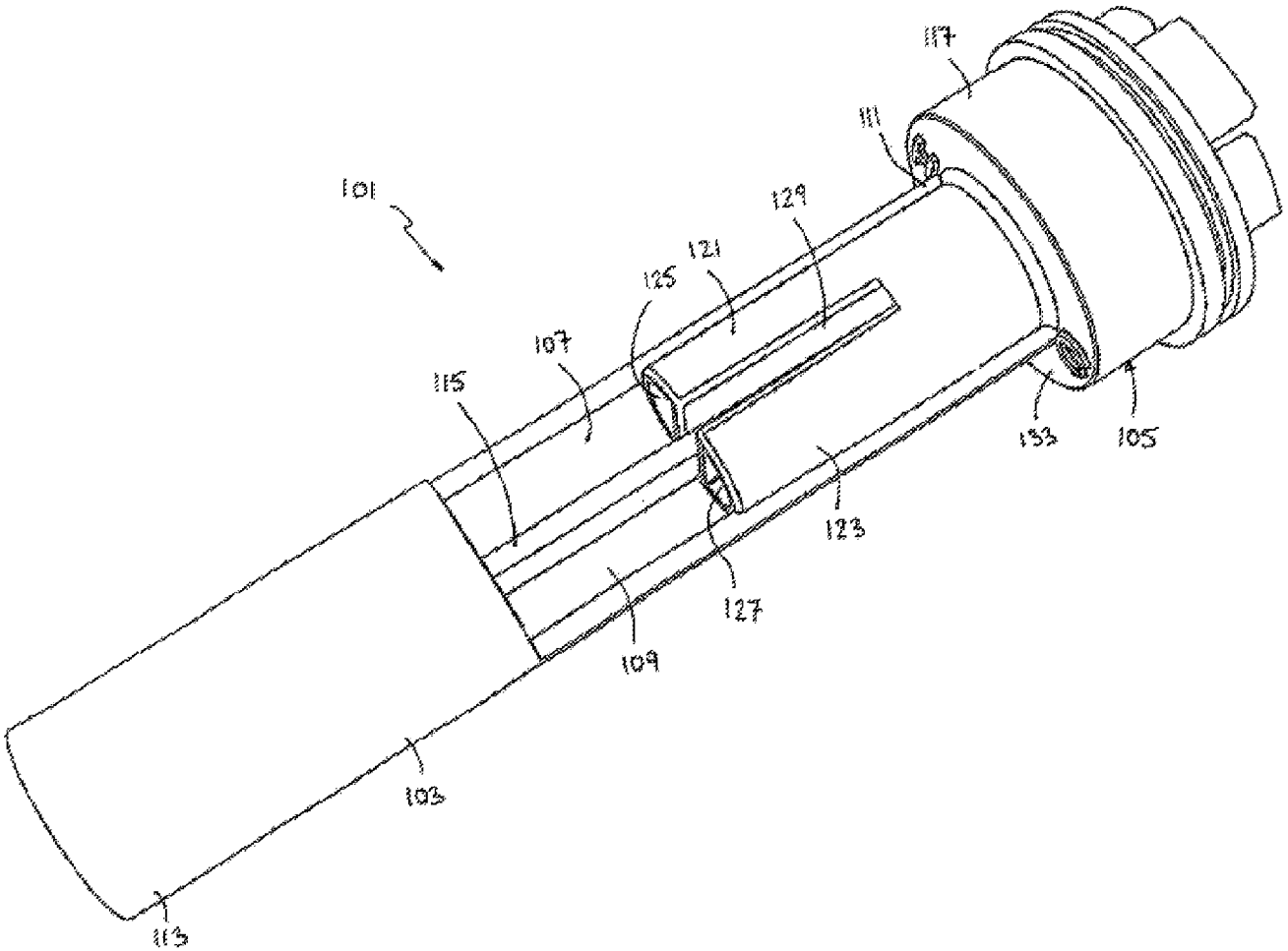
FIG. 7 is a perspective view of the hose assembly of FIG. 2 in an assembled state.

Referring now to FIGS. 6 and 7, there is shown, generally indicated as 101, a hose assembly embodying a further aspect of the invention. The hose assembly 101 comprises a hose 103 and an adaptor, or manifold, 105. The manifold 105 is connectable to a spray head, e.g. a shower head (not shown) or other dispensing device so that, in use, hot and cold water carried by the hose 103 can be supplied to the shower head or other water delivery device via the manifold 105. The hose 103 comprises first and second channels 107, 109 for carrying water between ends 111, 113 of the hose 103. The first and second channels 107, 109 are located adjacent to one another. In the preferred embodiment, this is achieved by providing a dividing wall 115 along the length of the hose 103. For hoses 103 with a transverse cross-section which is generally circular or otherwise rounded, this results in channels 107, 109 of substantially D-shaped cross-section. The illustrated hose 103 thus lends itself to manufacture by extrusion of plastics or other suitable material, e.g. poly silicone, or by any other suitable manufacturing method.

In alternative embodiments (not illustrated), the channels 107, 109 may be provided by a respective separate pipe located within the hose 103. In any event, it is preferred that each channel 107, 109 is incorporated within a single hose 103, preferably a hose of substantially circular transverse cross section. Alternatively, however, each channel may be provided by a respective conjoined tube or pipe, the pipes being joined together, or co-formed, along their respective lengths to provide parallel channels between the ends of the hose. It will be understood that the hose may have more than two channels. The or each additional channel being formed in any convenient manner, e.g. by an internal diving wall and/or one or more respective pipes. The or each additional channel may be used for any suitable purpose, e.g. carrying fluid (for example, water, pressurised air or liquid soap) or a utility cable, e.g. a power or communications cable.

In use, one end 111 of the hose 103 is connected to the manifold 105, the other end 113 being connected to a supply of hot and cold water (not shown). The hose 103 is connected to the water supply such that, in use, hot water is carried by one of the channels 107, 109, while cold water is carried by the other channel 109, 107. The hose 103 may be formed from any suitable material, typically plastics or rubber or other suitable material, e.g. poly silicone, and by any other suitable manufacturing method. Typically, the hose 103 is flexible. It is noted that, in the drawings, a portion of the end 111 of the hose 103 is cut away for illustration purposes only, and the hose 103 is shortened for convenience of illustration.

The manifold 105 has a body 117 which includes an inlet 119 comprising first and second plug members 121, 123, each having a respective aperture at its free end to provide first and second ports 125, 127 respectively. The plug members 121, 123 project from the body 117 in a direction substantially parallel with the longitudinal axis of the manifold 105 and substantially parallel with one another. The plugs 121, 123 are spaced apart to define a gap 129 therebetween. The plugs 121, 123 are shaped and dimensioned to fit into a respective channel 107, 109, preferably to substantially fill the respective channel 107, 109. The gap 129 is shaped and dimensioned to receive the wall 115. In the preferred embodiment, the plugs 121, 123 are substantially D-shaped in transverse cross section. The plugs 121, 123 are conveniently hollow or tube-like.

Advantageously, the body 117 is shaped to provide an abutment surface 133 around the inlet 119 against which the end 111 of the hose 103 may abut when the hose 103 and manifold 105 are assembled (FIG. 7).

In the preferred embodiment, the inlet 119 comprises a bifurcated male connector of which plugs 121, 123 are two branches extending from a common base 131. In this case, it is preferred that a portion of the wall 115 adjacent to the end 111 is cut away to allow the end 111 of the hose 103 to abut with the surface 133.

When the hose 103 and manifold 105 are assembled, water supplied through the respective channels 107, 109 enters the manifold through respective ports 125, 127 and passes through the respective plug members 121, 123. In cases where it is desired that the manifold 105 keep the two water supplies separate, the body 11 is shaped to define respective internal channels (not visible) which lead from the respective plugs 121, 123 through the body 117 and to a respective outlet (not visible) at an outlet port 135. The outlet port 135 may for example be substantially the same or similar to the outlet port 44 shown in FIG. 2.

The hose 103 may be secured to the manifold by any suitable means, for example a clip, tie or other clamping device (not shown), which may, for example, be located in register with the base 131 or the plugs 121, 123.

In order to feed hot and cold water into the other end 113 of the hose 103, any suitable adaptor or manifold (not shown) may be used. Advantageously, an adaptor or manifold having an outlet port substantially the same or similar to the inlet 119 may be used. It will be understood that the inlet 119 may alternatively serve as an outlet in other modes of use.

Figure 8:
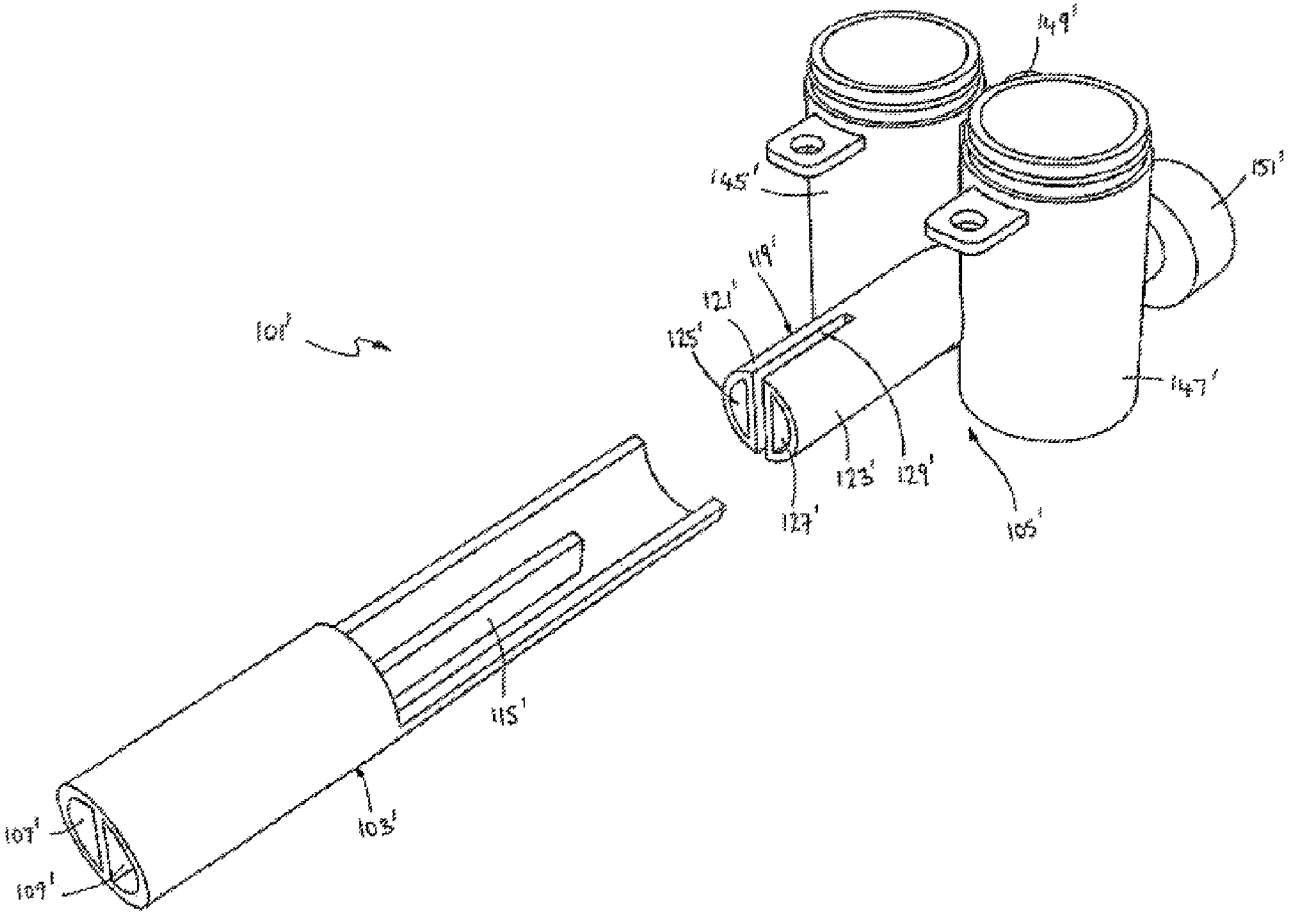
FIG. 8 is an exploded perspective view of an alternative hose assembly embodying said further aspect of the invention, a portion of the hose being cut away for purposes of illustration.
Figure 9:
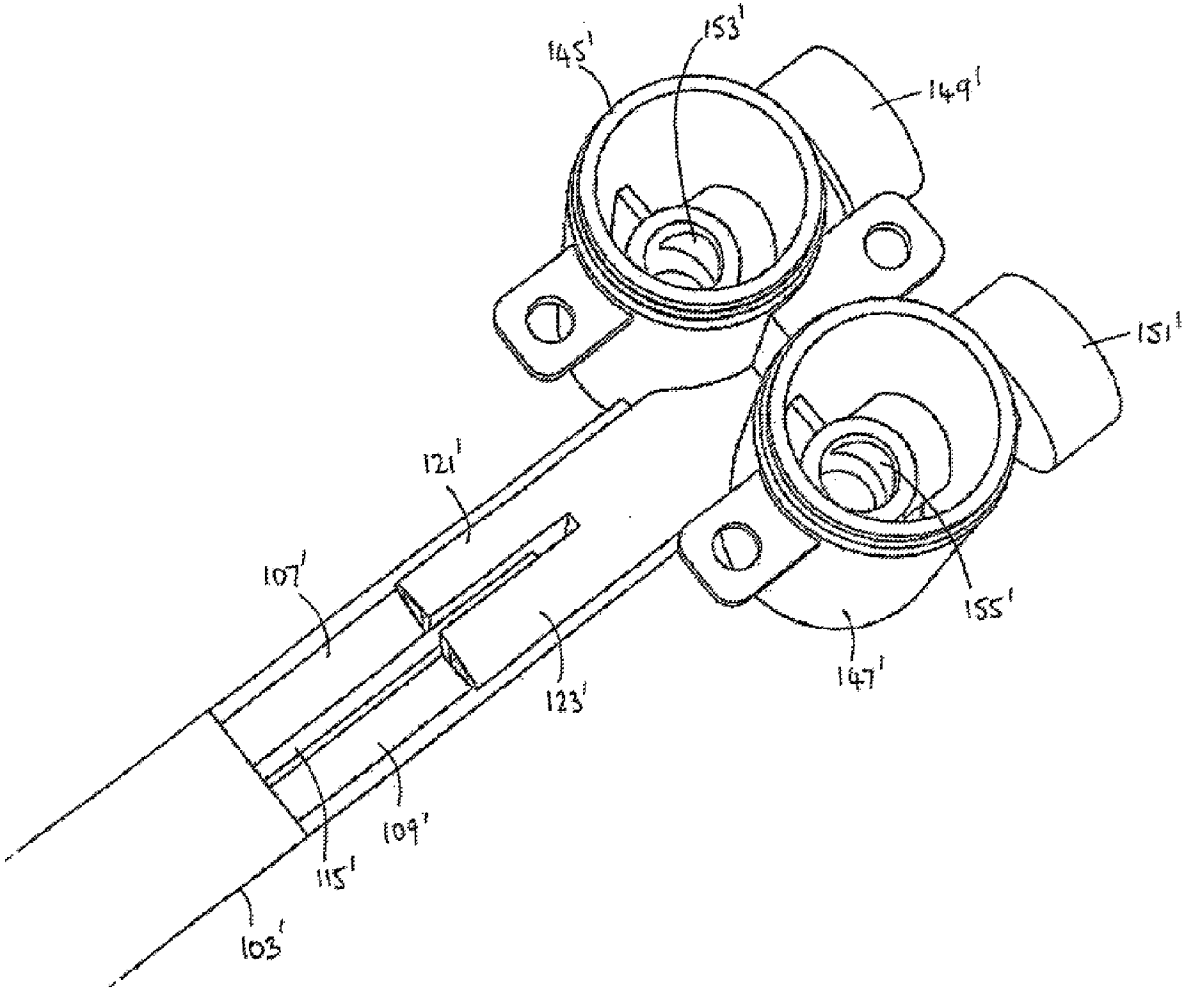
FIG. 9 is a perspective view of the hose assembly of FIG. 8 in an assembled state.
Figure 10:
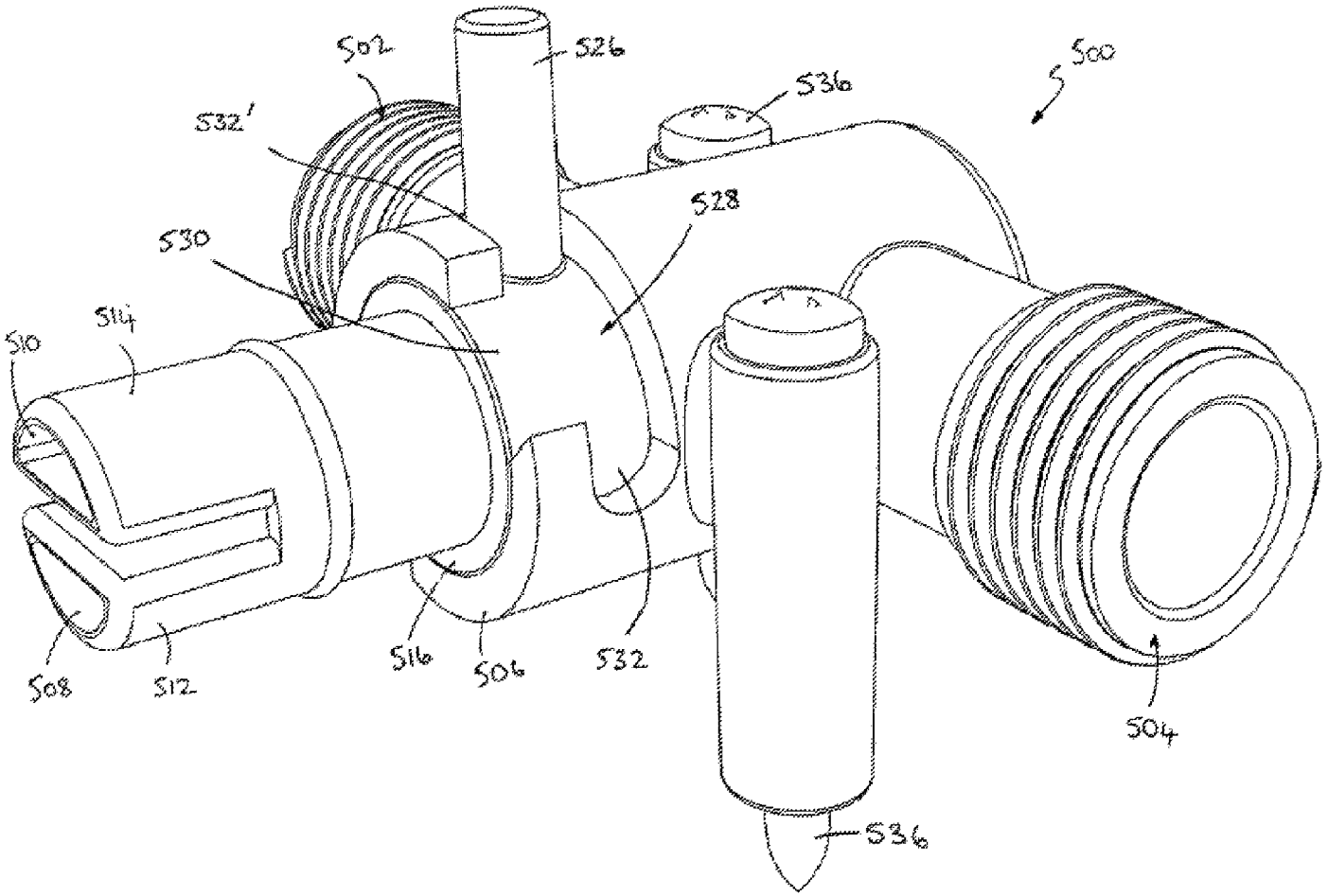
FIG. 10 is an exploded perspective view of a valve assembly, particularly suited for use with the hose of FIG. 6 of the drawings.

Referring now to FIGS. 8 and 9, there is shown, generally indicated as 101', an alternative hose assembly embodying one aspect of the invention. The hose assembly 101' comprises a hose 103' which may be substantially the same or identical to the hose 103 and in respect of which like numerals are used to indicate like parts. The hose assembly 101' also includes a manifold 105' which has an inlet 119' which is substantially similar or identical to the inlet 119 and in respect of which like numerals are used to indicate like parts. However, the manifold 105' further includes a respective housing 145, 147 for a respective pressure regulating device (not shown) for each channel provided through the manifold 105'. A respective outlet port 149', 151' is associated with each housing 145', 147'. The manifold 105' includes a respective channel leading from the respective port 125', 127', through the respective plugs 121', 123' and into a respective pressure regulating device located in the housings 145', 147'. Each housing 145', 147' has an outlet 153', 155' which leads to a respective outlet port 149', 151'. The housings 145', 147' may be shaped and dimensioned to received any suitable conventional water pressure regulator, for example a pressure regulator as described in UK patent GB 2 289 747.

The hoses described hereinbefore may be formed from any suitable material, e.g. poly silicone, plastics or rubber. Typically, the hoses are flexible. The manifolds described hereinbefore may be formed from any suitable material, especially plastics, and may conveniently be formed by conventional moulding processes. The hoses and manifolds are not limited to use for water delivery.

Referring now to FIGS. 10 to 13, there is show the preferred embodiment of a valve apparatus generally indicated as 500. The valve apparatus 500 is particularly intended for use with a fluid, and especially a liquid, distribution system in which at least two separate sources of fluid are to be distributed separately. The assembly 500 is especially suited for use in the distribution of separate hot and cold water supplies. The valve 500 may serve as a water delivery device in that it may deliver water from the hoses described herein to hot and cold water sources, or vice versa.

The valve apparatus 500 comprises first and second ports 502, 504 in fluid communication with a body 506. The apparatus 500 has third and fourth ports 508, 510 selectable connectable to a respective one of the first and second ports 502, 504. In typical use, when the first and second ports serve as inlets to the valve 500, the third and fourth ports serve as outlets from the valve 500, and vice versa. The assembly 500 is operable between an open state in which the first port 502 is in fluid communication with the third port 508 and the second port 504 is in fluid communication with the fourth port 510, and a closed state in which the ports 502-510 are isolated from one another so that fluid cannot flow through the valve 500.

The ports 508, 510 are provided in respective plugs 512, 514. Together, the plugs 512, 514 provide a male connector which is suitable for insertion into a hose, or other conduit, for transporting the water to or from the valve assembly 500. The plugs 512, 514, and therefore the connector formed by them, may for example be substantially the same as the plugs/connectors illustrated in and described with reference to the FIGS. 6, 7 and 8. Moreover, the hose or conduit, which is shown is FIG. 12, may be substantially the same or similar to the hose 103 illustrated in FIGS. 6, 7 and 8.

In the preferred embodiment, the plugs 512, 514 are provided on a core member 516 which is located in, or removably locatable in, the body 506. The core 516 includes a respective inlet/outlet 518, 520 and a respective channel 522, 524 for allowing fluid to flow from the respective ports 502, 504 to the respective ports 508, 510 and vice versa. When the valve assembly 500 is in the open state (FIG. 13), the inlets/outlets 518, 520 are in register with, or substantially in register with, the ports 502, 504 to allow fluid to flow from the ports 502, 504 into the core 516 via the inlets 518, 520, or vice versa. When the assembly 500 is in the closed state, the inlets/outlets 518, 520 are not in register with the ports 502, 504 in order to prevent fluid flowing from the ports 502, 504 into the core 516.

In the preferred embodiment, the core 516 is rotatable within the body 506 between the open and closed states. In particular, the core 516 is located inside, and is substantially coaxially with, the body 506 and is rotatable about their common axis. To this end, the core 516 and the body 506 are preferably substantially cylindrical in shape. Conveniently, a lug or handle 526 is provided on the core 516, or in any other convenient location, to allow the core 516 to be actuated between the open and closed states. In the preferred embodiment, the core 516 is removably insertable into the body 506.

Preferably, a locking mechanism is provided to hold the core 516 within the body 506. The preferred locking mechanism comprises a co-operable pin and slot mechanism having a slot conveniently formed in the body 506, and a pin 526 conveniently provided on the core 516. The slot 528 includes an opening 530 through which the pin 526 can enter and leave the slot and at least one seat 532 for receiving the pin in a locked state, the shape of the slot 528 being such that, when the pin 526 is seated in one of said seats 532, engagement of the pin 526 and the walls of the slot 528 prevent the core 516 from being withdrawn from the body 506 in an axial direction.

In the preferred embodiment, the handle 526 serves as the pin, and the slot 528 has two seats 532, 532' corresponding to the open and closed states of the valve assembly 500 respectively. By way of example, the slot 528 may be substantially T shaped.

Seals 534 may be provided between the external surface of the core 516 and the internal surface of the body 506 as required. Pins and sockets 536, 538 may be provided for fixing the valve 500 to a suitable support structure (not shown).

Figure 11:
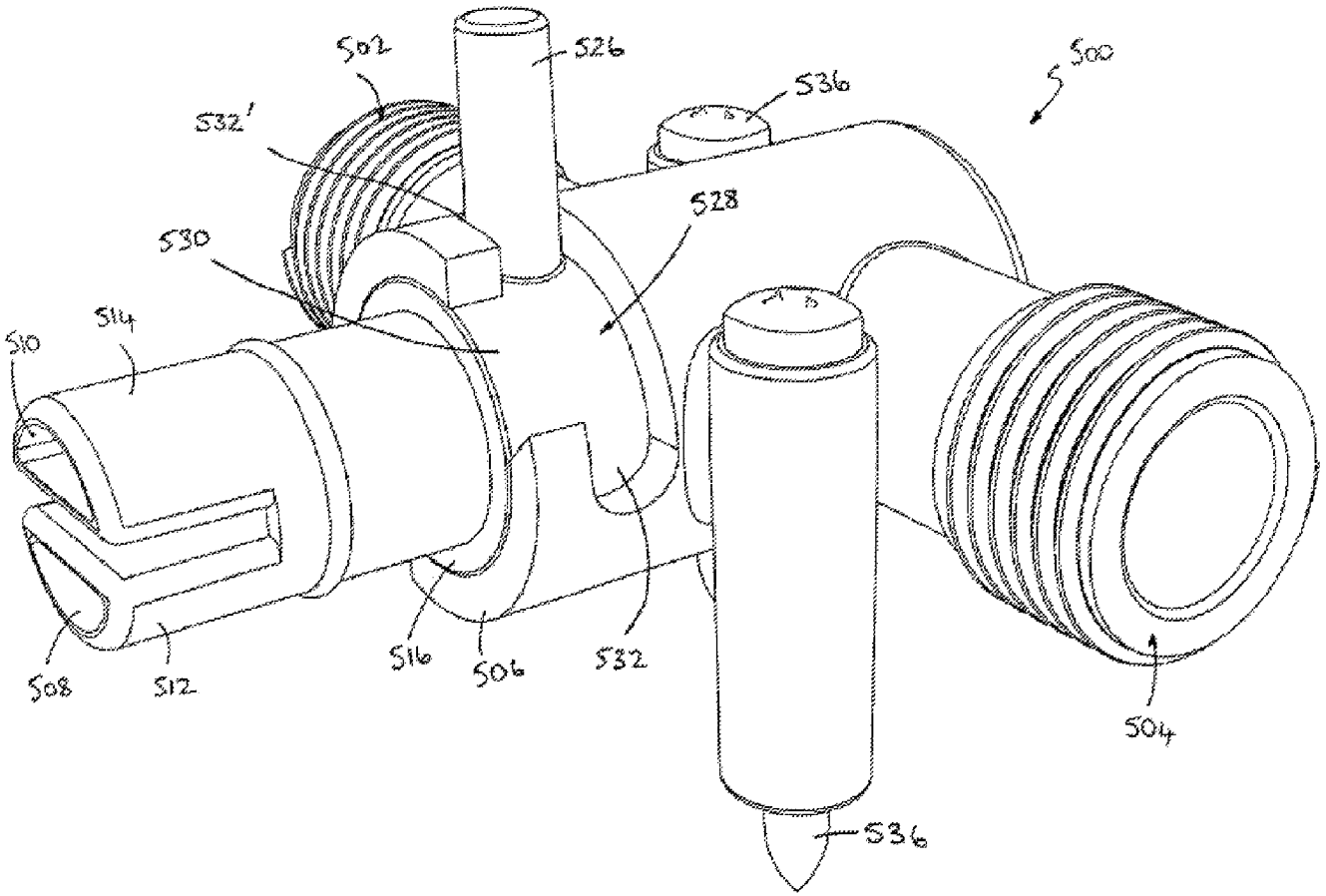
FIG. 11 is a perspective view of the valve assembly of FIG. 10 shown in a first mode of use.
Figure 12:
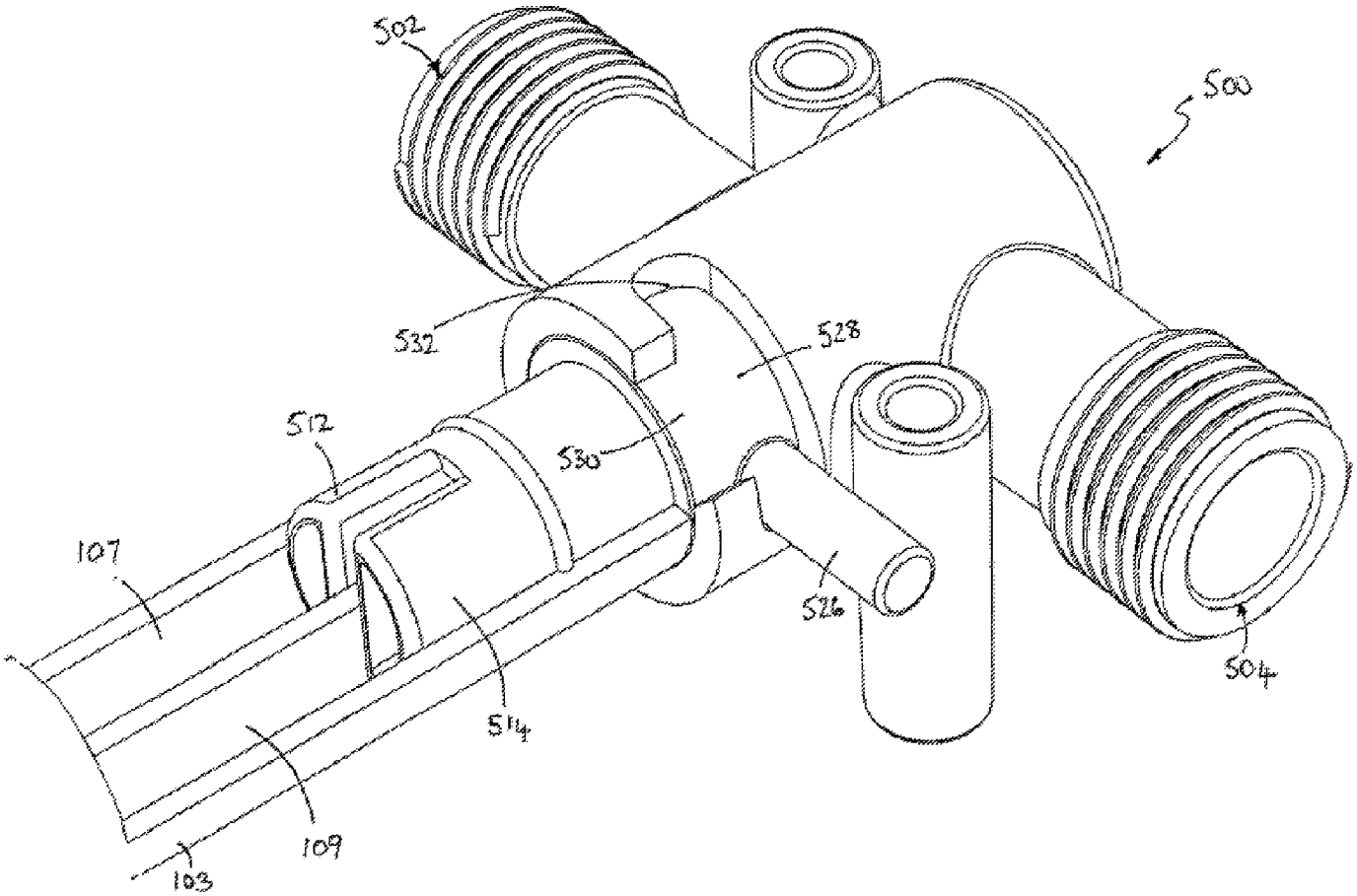
FIG. 12 is a perspective view of the valve assembly of FIG. 10 shown in a second mode of use and shown fitted to a hose of the type shown in FIG. 6.
Figure 13:
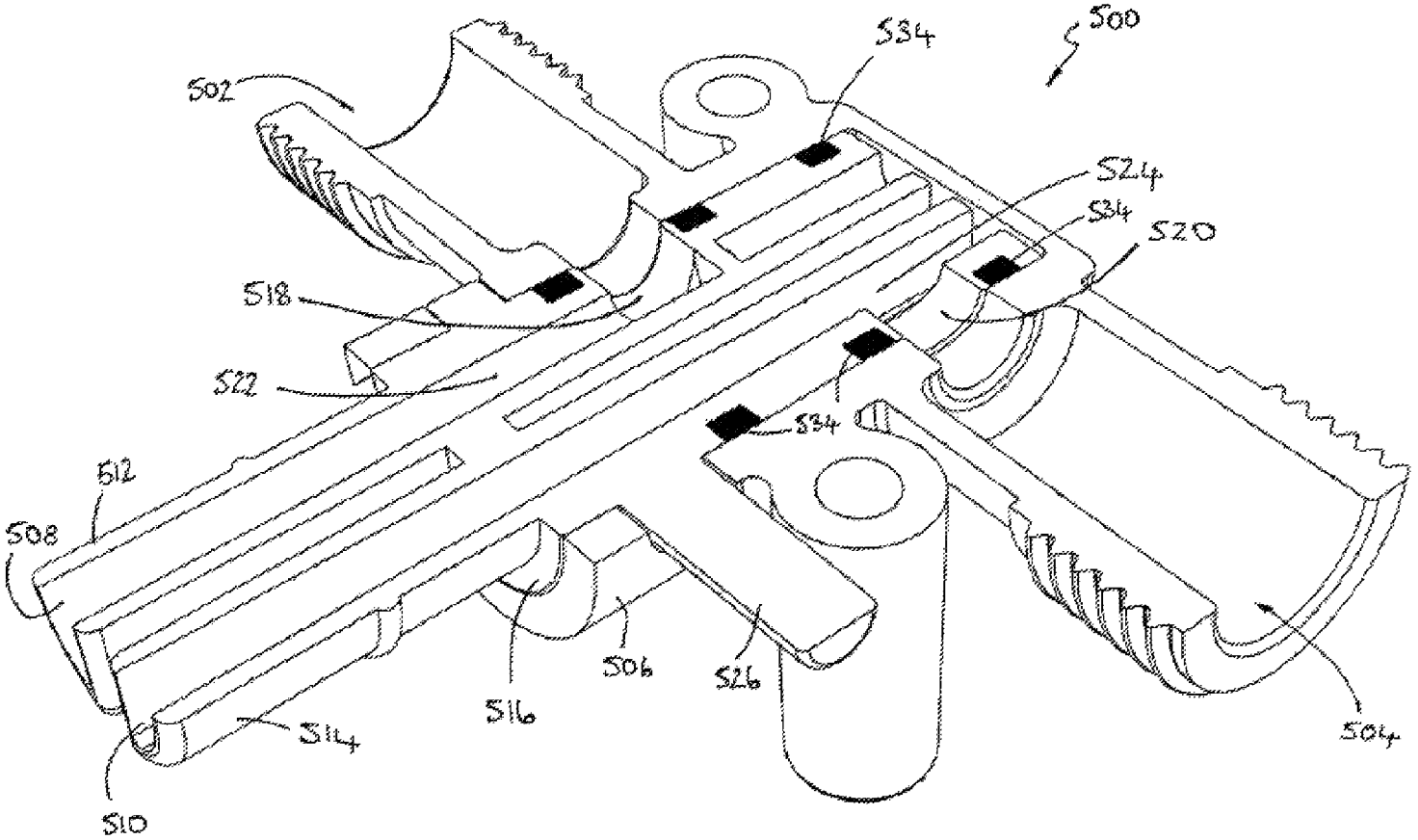
FIG. 13 is a cutaway perspective view of the valve assembly FIG. 10.

In use, assuming by way of example that the ports 502, 504 are serving as inlets and the ports 508, 510 are serving as outlets, the inlets 502, 504 may each be connected to a respective fluid source, and in particular to a separate water supply, e.g. a hot and a cold water supply. The connector formed by the plugs 512, 514 is inserted into a hose 103, or similar conduit, such that the plugs 512, 514 are inserted into respective channels 507, 509 of the hose 103. With the valve assembly 500 in an open state (as shown in FIGS. 12 and 13) water from the respective supplies is allowed to enter the valve assembly by respective inlets 502, 504 and to leave the valve by respective outlets 508, 510 whereupon it is transported onwards in respective channels 107, 109 of the hose 103. Hence, the respective water supplies are kept separate. When the valve apparatus 500 is in the closed state (as shown in FIG. 11) the water is prevented from passing through the valve 500 and out of the outlets 508, 510.

Figure 14:
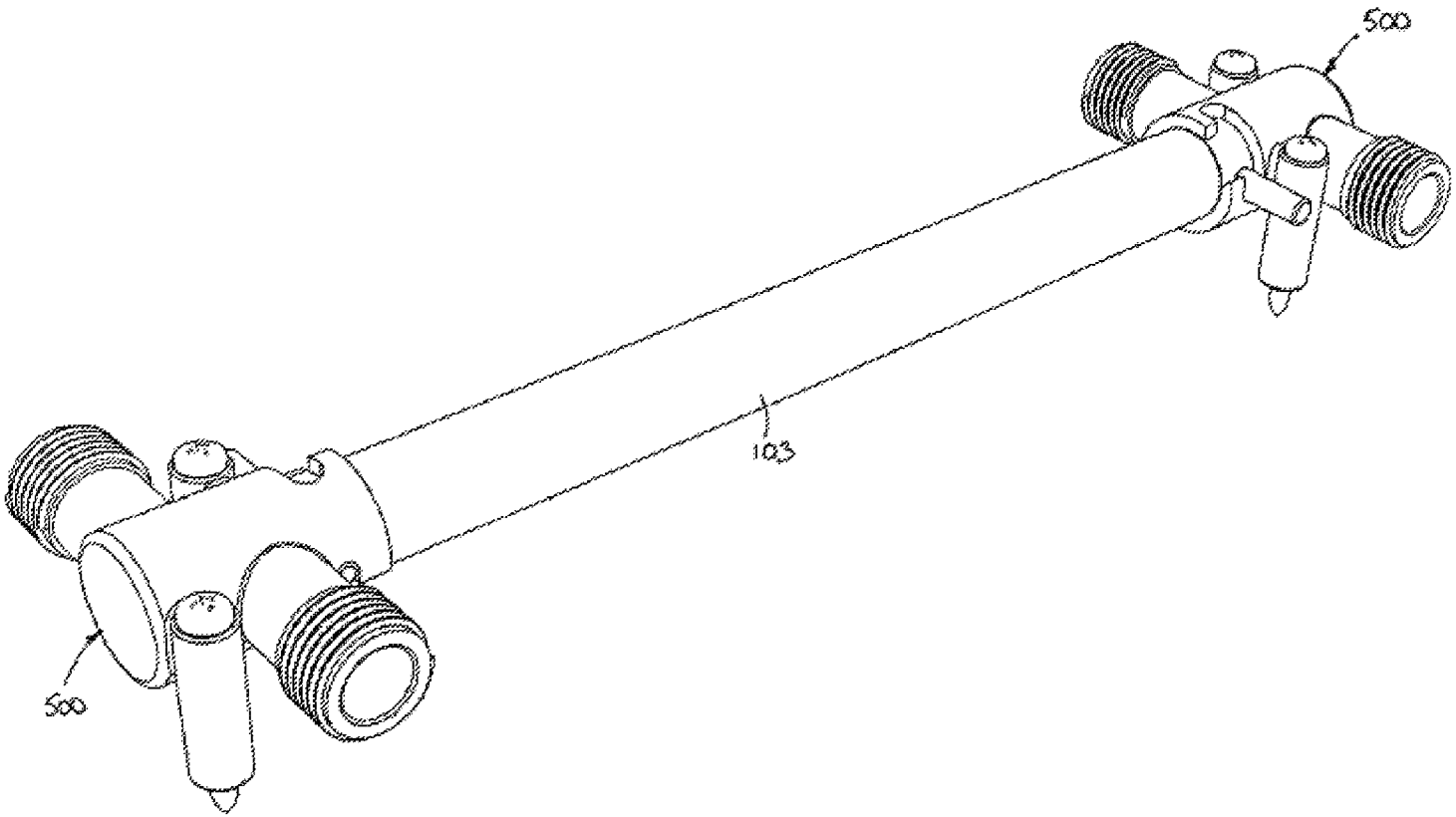
FIG. 14 is a perspective view of two valve assemblies of FIG. 10 joined by a hose.

The valve apparatus 500 facilitates provision of a fluid transport or distribution system in which two or more sources of fluid may be transported separately via a single hose or conduit. Referring for example to FIG. 14, there is shown first and second valve apparatus 500 joined by a multi-channel hose, for example the hose 103. The assembly shown in FIG. 14 may be used, for example, in situations where two separate water or fluid supplies are to be transported or distributed across a distance, for example from one end of a boat to another. Conventionally, this would involve the routing of two separate hoses. However, the valves 500 together with the hose 103 allow this to be done using a single hose. It will be apparent that the ports 502, 504, 508, 510 may serve as inlets or outlets.

Figure 15:
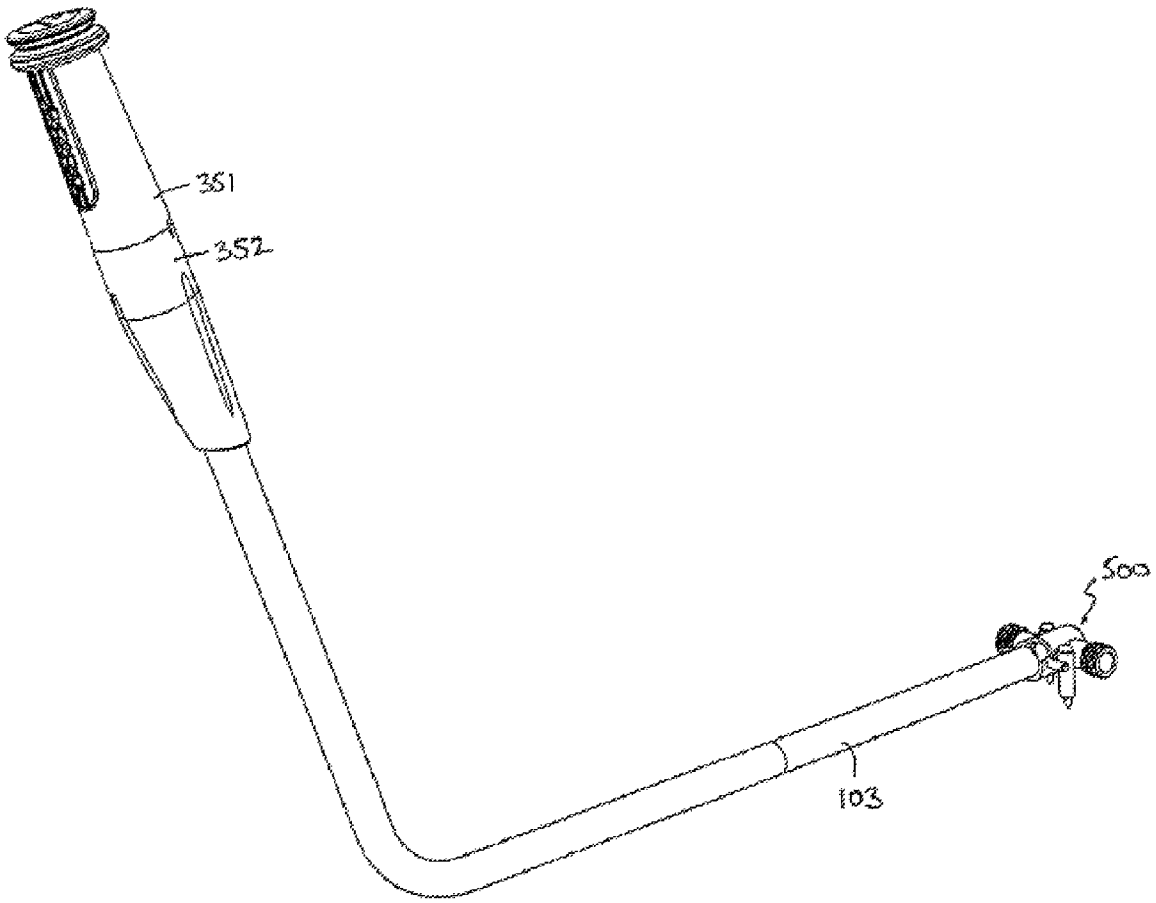
FIG. 15 is a perspective view of the valve assembly of FIG. 10 connected to a spray head by a hose.

Referring now to FIG. 15, the valve 500 and hose 103 are shown in use supplying both hot and cold water to a spray head 351, for example the water dispensing head of a shower, or other nozzle. The spray head 351 includes a mixing device (not shown) for mixing the hot and cold water received by it during use. The mixing device may take any suitable form and, typically, includes user operable control means for controlling the relative quantities of hot and cold water being mixed. In the example of FIG. 15, the mixing device is controllable by means of a rotatable collar 352. Although not shown, the manifold 14 of FIGS. 6 to 8, or other adaptor, may be located inside the body of the spray head 351 connecting the hose 103 to the mixing device.

Alternatively, the hoses described herein may be used to supply hot and cold water simultaneously to any other device, especially water dispensing devices, e.g. taps. The devices preferably include a controllable mixing device for mixing the hot and cold water before dispensing, but any other mixing means may be provided, e.g. a mixing chamber into which both the hot and cold water are fed without any control device.

It will be apparent that hose assemblies embodying the invention are not limited to use with shower units or to carrying water, and may be used in general to carry fluids, especially liquids, in any suitable application.

The invention is not limited to the embodiments described herein and may be modified or varied without departing from the scope of the invention.

The invention claimed is:

1. A hot and cold water delivery apparatus comprising a flexible hose having a first channel for carrying hot water during use, and a second channel for carrying cold water during use, wherein a first end of said hose is connectable both to a source of hot water and a source of cold water, a second end of the hose being connected to a shower spray head, the shower spray head having a first port connected to said first channel and a second port connected to said second channel, said shower spray head comprising a controllable mixing device for mixing water received, in use, from said first and second channels, the mixing device being controllable to adjust the relative quantities of hot and cold water mixed during use, the delivery apparatus further comprising a valve apparatus having a first valve apparatus port connected to said first channel at said first end of the hose and a second valve apparatus port connected to said second channel at said first end of the hose, said valve apparatus having a third valve apparatus port and a fourth valve apparatus port in selectable fluid communication with said first valve apparatus port and said second valve apparatus port respectively, the third valve apparatus port being connectable to said source of hot water and the fourth valve apparatus port being connectable to said source of cold water, the valve apparatus being operable between an open state, in which said third valve apparatus port is in fluid communication with said first valve apparatus port, and said fourth valve apparatus port is in fluid communication with said second valve apparatus port, and a closed state in which the third valve apparatus port is isolated from said first valve apparatus port, and said fourth valve apparatus port is isolated from said second valve apparatus port, wherein said valve apparatus comprises a core member rotatably located in a body, said first and second valve apparatus ports being provided on said core member, said third and fourth valve apparatus ports being provided on said body, said core member including respective core channels for carrying water between said respective valve apparatus ports, said core channels being in fluid communication with, or isolated from, said third and fourth valve apparatus ports depending on the relative rotational position of said core and said body, and wherein said first and second valve apparatus ports are provided by a first plug and a second plug respectively, the first and second plugs being provided on the rotatable core member, the first plug being inserted into the first channel and the second plug being inserted into the second channel.

2. A water delivery apparatus as claimed in claim 1, wherein said first and second channels are located side-by-side and run along substantially the entire length of the hose.

3. A water delivery apparatus as claimed in claim 2, wherein said first and second channels are formed by a dividing wall running longitudinally of the hose.

4. A water delivery apparatus as claimed in claim 2, wherein said hose comprises a length of extruded material.

5. A water delivery apparatus as claimed in claim 1, wherein said first and second channels are formed by a dividing wall running longitudinally of the hose and wherein said plugs are mutually spaced apart to define a gap therebetween, the gap being shaped and dimensioned to receive said dividing wall.

6. A water delivery apparatus as claimed in claim 5, wherein a first abutment surface is provided in said gap, an end of said dividing wall abutting against said first abutment surface.

7. A water delivery apparatus as claimed in claim 1, wherein a peripheral abutment surface is provided at least partially around said plugs, said first end of the hose abutting with said peripheral abutment surface.

8. A water delivery apparatus as claimed in claim 7, wherein a first abutment surface is provided in said gap, an end of said dividing wall abutting against said first abutment surface and wherein said peripheral abutment surface is recessed with respect to said first abutment surface and said end of the dividing wall is correspondingly recessed with respect to said first end of the hose.

9. A water delivery apparatus as claimed in claim 1, wherein said core member includes a handle for effecting rotation of the core member with respect to the body to operate the valve apparatus between said open and closed states.

10. A water delivery apparatus as claimed in claim 9, wherein said handle projects laterally from the core member and extends through a slot formed in said body, said slot being shaped to define a first seat for the handle and a second seat for the handle, wherein said handle is movable along said slot upon rotation of said core member between said first and second seats, and wherein when said handle is in said first seat said valve apparatus is in said open state, and when said handle is in said second seat said valve apparatus is in said closed state.

11. A water delivery apparatus as claimed in claim 1, wherein said third and fourth valve apparatus ports are spaced apart on said valve apparatus.

12. A water delivery apparatus comprising a valve apparatus having a third valve apparatus port and fourth valve apparatus port in selectable fluid communication with a first valve apparatus port and a second valve apparatus port respectively, the valve apparatus being operable between an open state, in which said third valve apparatus port is in fluid communication with said first valve apparatus port, and said fourth valve apparatus port is in fluid communication with said second valve apparatus port, and a closed state in which third valve apparatus port is isolated from said first valve apparatus port, and said fourth valve apparatus port is isolated from said second valve apparatus port, wherein said valve apparatus comprises a core member rotatably located in a body, said first and second valve apparatus ports being provided on said core member, said third and fourth valve apparatus ports being provided on said body, said core member including respective core channels for carrying liquid between said respective valve apparatus ports, said core channels being in fluid communication with, or isolated from, said third and fourth valve apparatus ports depending on the relative rotational position of said core and said body, and wherein said first and second valve apparatus ports are provided by a first plug and a second plug respectively, the first and second plugs being provided on the rotatable core member.

13. The water delivery apparatus of claim 12, wherein said first and second plugs are disposed parallel with each other.

14. The water delivery apparatus of claim 12, wherein said first and second plugs project from an end of said core member in a direction parallel with a rotational axis of the core member.

15. The water delivery apparatus of claim 12, further comprising a hose having a first and second liquid channels extending along its length, said first plug being inserted into the first channel and the second plug being inserted into the second channel.

16. The water delivery apparatus of claim 12, wherein said wherein said core member includes a handle for effecting rotation of the core member with respect to the body to operate the valve apparatus between said open and closed states, said handle projecting laterally from the core member and extending through a slot formed in said body, said slot being shaped to define a first seat for the handle and a second seat for the handle, wherein said handle is movable along said slot upon rotation of said core member between said first and second seats, and wherein when said handle is in said first seat said valve apparatus is in said open state, and when said handle is in said second seat said valve apparatus is in said closed state.

17. The water delivery apparatus of claim 16, wherein said core member is removable from said body in a direction along the rotational axis of the core member, said slot including an opening between said first and second seats through which the handle can enter and leave the slot to allow the core member to be removed from or inserted into said body.

* * * * *